United States Patent [19]

Meyer et al.

[11] Patent Number: 4,835,937

[45] Date of Patent: Jun. 6, 1989

[54] APPARATUS FOR PROVIDING INERT ATMOSPHERE IN AIRTIGHT PACKAGES FOR FOOD PRODUCTS

[75] Inventors: Jean-Marc Meyer, Versailles; Jean-Luc Mizandjian, Igny, both of France

[73] Assignee: L'Air Liquide, Paris, France

[21] Appl. No.: 175,507

[22] Filed: Mar. 30, 1988

[30] Foreign Application Priority Data

Mar. 30, 1987 [FR] France ..... 87 04367

[51] Int. Cl.[4] ..... B65B 55/04

[52] U.S. Cl. ..... 53/88; 53/110; 53/161; 53/426; 53/510

[58] Field of Search ..... 53/426, 510, 167, 432, 53/88, 110

[56] References Cited

U.S. PATENT DOCUMENTS 2,630,957 3/1953 Hohl et al. .
2,630,958 3/1953 Hohl ..... 53/432 X
3,477,192 11/1969 Brown ..... 53/432
3,566,575 3/1971 Lisiecki ..... 53/426
3,911,640 10/1975 Rausing ..... 53/426
4,140,159 2/1979 Domke ..... 53/510 X
4,602,473 7/1986 Hayashi ..... 53/510

FOREIGN PATENT DOCUMENTS 8606347 11/1986 France .

*Primary Examiner*—John Sipos
*Attorney, Agent, or Firm*—Browdy & Neimark

[57] ABSTRACT

Apparatus is provided for providing an inert atmosphere in airtight packages, which apparatus is adaptable for use in a packaging line. The apparatus comprises an inerting minitunnel which is provided with a ramp for purging oxygen from the packages, and an inerting ramp. The apparatus can be used with any liquid, pasty, or solid product which is packaged in an airtight package.

14 Claims, 4 Drawing Sheets

APPARATUS FOR PROVIDING INERT ATMOSPHERE IN AIRTIGHT PACKAGES FOR FOOD PRODUCTS

FIELD OF THE INVENTION

This invention relates to an apparatus for providing an inert atmosphere for airtight packages for food products.

BACKGROUND OF THE INVENTION

Food products, particularly liquid or pasty products, in contact with ambient air are subjected to numerous risks of biochemical or microbiological alterations which include darkenings, loss of flavor, loss of vitamins, and development of disagreeble tastes.

The risks of degradation of these products, correctly controlled during production, remain very great during storage after packaging. To reduce degradation and to increase the period of preservation, it is essential to reduce the oxygen content of the gas volume of the packages: on empty packages to limit the reoxygenation of the product during filling and/or on filled packages to avoid the presence of gaseous oxygen on the surface of the product.

There are numerous techniques and equipment making it possible to reduce the gaseous oxygen content of airtight packages of liquid, pasty or solid products passing on a packaging line.

Subjecting the contents and the package to a vacuum, with or without gaseous compensation, is very effective for packaging solid products; it becomes difficult to use on liquid or pasty products because the value of the vacuum used remains limited by the risks of aspiration of the product. This technique cannot be used for high packaging rates, it uses expensive equipment, and it is difficult to integrate in a packaging line of liquid or pasty products.

Simple gas sweeping has been proposed. In this method, the oxygen is purged by an injection of inert gas; residual contents of gaseous oxygen of less than 2% are difficult to achieve, the purge being performed in ambient air atmosphere.

According to another technique, desorption of dissolved gas is used, and the gaseous medium of the packages can be rendered inert by purging the oxygen with an inert gas previously dissolved in the liquid. This is the case, for example, of carbonated beverages such as beer where the desorption of the $CO_2$, obtained by injection of hot water on the surface of the liquid, causes a foaming and an inerting of the gaseous medium of the package. The drawback of this technique is that a foam is created that can impede closing of the package and cause considerable losses of the liquid (an average of 1 to 2%).

Further, the oxygen content of airtight packages of food products can be reduced by injection of a cryogenic fluid. According to this technique, after injection of the cryogenic fluid—essentially nitrogen or carbon dioxide—inerting of the package is obtained by vaporation of the fluid and purging of the oxygen by the generated inert gas. The efficiency of inerting of such systems on high-rate packaging lines remains imperfect, the average contents of residual oxygen of the packages being very variable and, on the average, greater than 2%.

To avoid degradation of certain food products, particularly liquids and pastes, it is essential to lower the oxygen content of the air in contact with these products to values below 2%.

Within the context of preserving food products, inerting equipment was sought that would be easy to adapt to a packaging line, making it possible to assure filling of the packages and/or storage of the packaged product in a gaseous medium at less than 2% oxygen.

SUMMARY OF THE INVENTION

According to the invention, there is proposed equipment for providng an inert atmosphere in airtight packages for liquid, pasty or solid food products, adaptable to a packaging line before, either or before and after the filling station, associating several technical arrangements. This equipment consists of an inerting minitunnel comprising a hood covering the upper part of said packages, fitted close to the profile of the packages so that the passage of the latter is free on the inside of the inerting minitunnel, said inerting tunnel comprising a distributor for purging of the oxygen of the packages, of maximum length relative to the hood of the inerting tunnel, fastened to its upper part and formed by an inerting gas feed duct and a plurality of injectors placed immediately above the packages, and also comprising an inerting distributor generating a continuous stream of inerting gas in the minitunnel, of a length equal to the hood of the minitunnel fastened to its upper lateral part.

The inerting minitunnel, which has a linear or arcuate shape, fits the profile of the packages with a passage section barely greater than their outside cross section. As a function of the dimensions of the package, the height of the hood of the minitunnel is less than or at most equal to twice the height of the packages, and is preferably placed above the upper part of the packages and covering a third of their height. The intake section of the inerting minitunnel is calculated so that it is minimal.

According to an advantageous embodiment, upstream from the purge distributor, the package inerting minitunnel comprises at its upper part a device for injection of the inertin gas, directed downward, forming a gas curtain covering the totality of the section of the inerting minitunnel. This device is put in place to limit the intake of air in the inerting minitunnel, due to the passage flow of the packages. This inerting gas injection means, placed perpendicular to the passage flow of packages or obliquely relative to the latter, preferably at 45°, forms a vertical or oblique inert gas curtain, covering the intake section of the inerting minitunnel. This device for forming a gas curtain, for example, can consist of a nozzle with a flat jet.

The inerting minutunnel is provided with a device, consisting of a distributor for purging the oxygen of the packages. This purge distributor, formed by an inerting gas feed duct and several injectors above the packages, of maximum length relative to the hood of the minitunnel is fastened to its upper part. The injectors are preferably cylindrical, vertical, directed downward and placed some millimeters from the surface of the packages, a distance between 3 and 5 millimeters is quite satisfactory. Further, the purge distributor comprises between 1 and 10 injectors per package distances between centers.

Further, the inerting minitunnel comprises a gas distribution network consisting of an inerting distributor, generating a continuous stream of inerting gas making it possible to purge the hood of the minitunnel of oxygen coming from the packages. This distributor, of length equal to that of the hood, is fastened to its upper part, and the gas injection is performed through a parallelepipedic section of a length equal to that of the hood and the minimum height being able to be 2 millimeters, a height of 5 millimeters to 10 millimeters being quite satisfactory.

Vertical slats placed on the inside of the lateral inerting distributor, regularly spaced, for example, on the order of 0.5 to 10 centimeters, assure the division of the inerting delivery into several gas streams. These steams, thus channeled, improve the efficiency of the inerting by limiting entrainments and the phenomena of gas mixtures under the inerting minitunnel.

The inerting installation can be placed before, after, or on both sides of the package filling station.

According to the proposed technical solution, the oxygen of the packages of the packaging line is purged by injection of an inerting gas inside the latter, assuring an inert ambient atmosphere around the packages; the atmosphere is obtained by isolating the packages by the inerting minitunnel, by limiting the intake of air due to the passage flow of the bottles and packages by a gas curtain and by driving out the purged air by a gas distribution network.

The equipment for inerting of airtight packages according to the invention exhibits a great flexibility, associated with numerous advantages. Its use makes it possible to achieve an oxygen content of the filled packages after inserting less than or equal to 2%, or even on the order of 0.5%.

The equipment proposed according to the invention offers the possibility of treating variable gas volumes ranging from several millimeters to several liters.

It also makes it possible to maintain the rates of packaing lines, these latter being able to reach up to 60,000 packages per hour.

Further, the equipment according to the invention makes it possible to reduce the inerting times imposed by the packaging systems to some tenths of a second.

The technique of package inerting used starting from the equipment according to the invention is applicable to the preservation of any liquid, pasty, solid or powdery product packaged in an airtight package, such as beer, wine, fruit juice, milk products, oils and derivatives, lipidic products, pharmaceutical and biological products, powders and grains.

BRIEF DESCRIPTION OF THE DRAWINGS

The unit of the packaging and inerting installation is represented in FIG. 1 of the accompanying drawing.

DETAILED DESCRIPTION OF EMBODIMENTS

Figure 1:
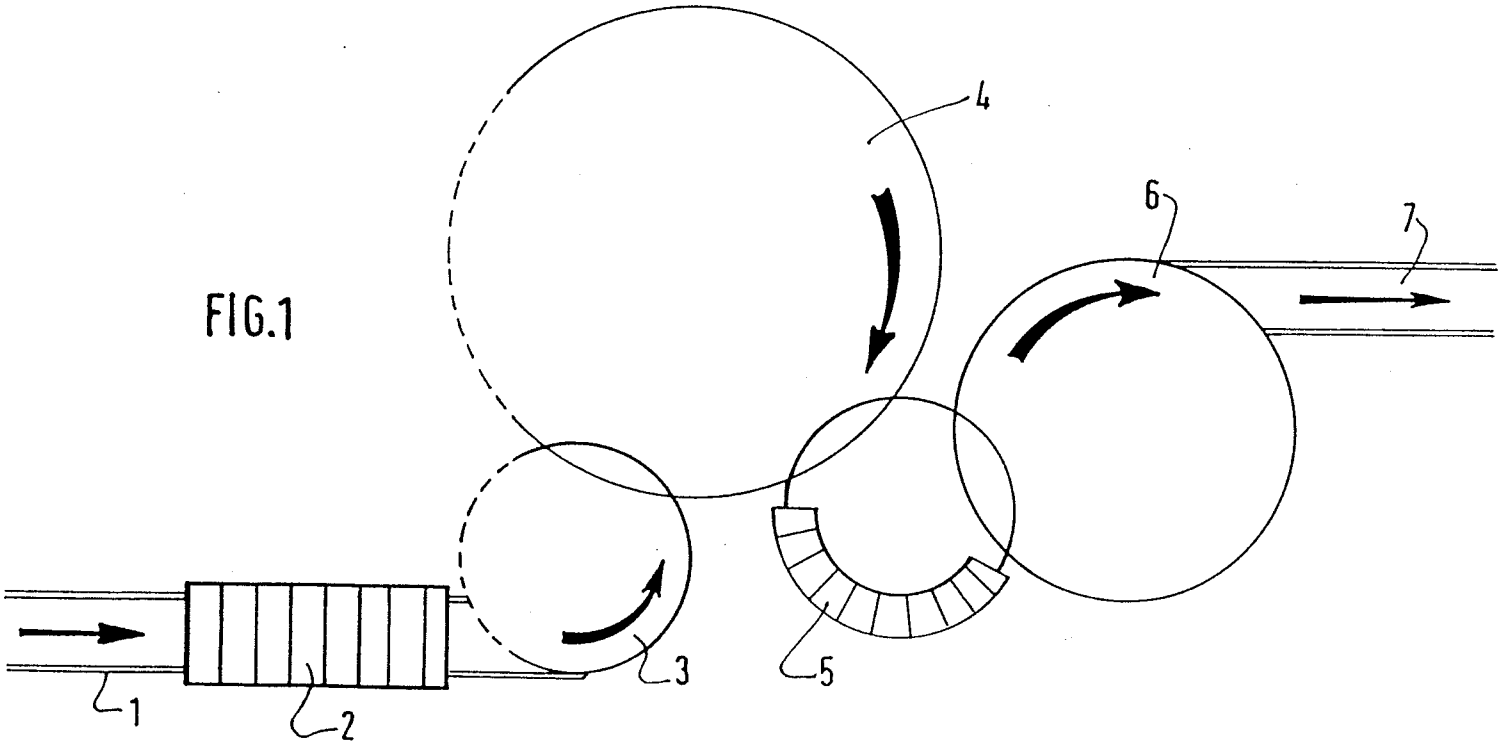

As shown in FIG. 1, the flow of empty packages traveling on a conveyor belt (1) is introduced to the inside of the linear inerting minitunnel (2). The purged empty packages are sent by a transfer star wheel (3) to filling station (4); the filled packages are then introduced into a semicircular inerting minitunnel (5), and the filled and inerted packages are routed to the capping station (6), then directed to storage (7).

Figure 2:
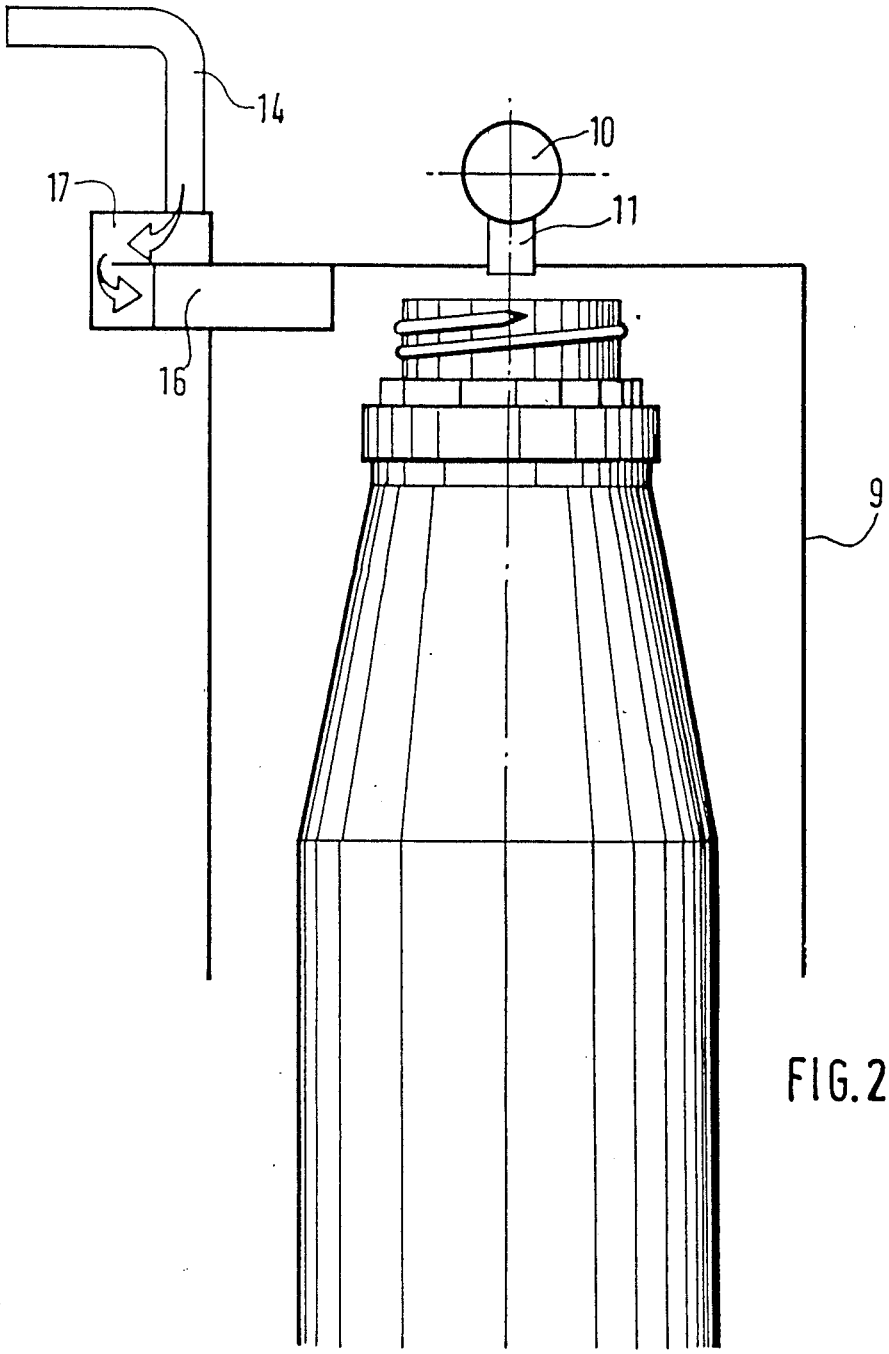
FIG. 2 is a cross-sectional view of the inerting minitunnel.

FIG. 2 of the accompanying drawing gives a view in cross section of the inerting minitunnel consisting of a hood (9) covering the upper part of the package.

A purge distributor (8) for purging the oxygen of the packages is fastened to the upper part of the hood (9) of the minitunnel and is formed by inerting gas feed pipe (10) and vertical injection pipes (11) placed some millimeters from the surface of the packages.

Inerting distributor (17) of the minitunnel (see FIGS. 2 and 4–6) is fastened to the lateral upper part of the hood (9) and is fed by injection pipes (14), the gas going through ramp (17) and being distributed into several streams by slats (16).

As above in FIG. 2, the distributor (8) for purging the oxygen from the packages, which are partially represented, fastened to the upper part of the hood (9) of the isolation minitunnels (2) and (5), is formed by an inerting gas feed pipe (10) and several vertical cylindrical injection pipes (11) directed downwardly, placed several millimeters from the surface of the packages.

Figure 3:
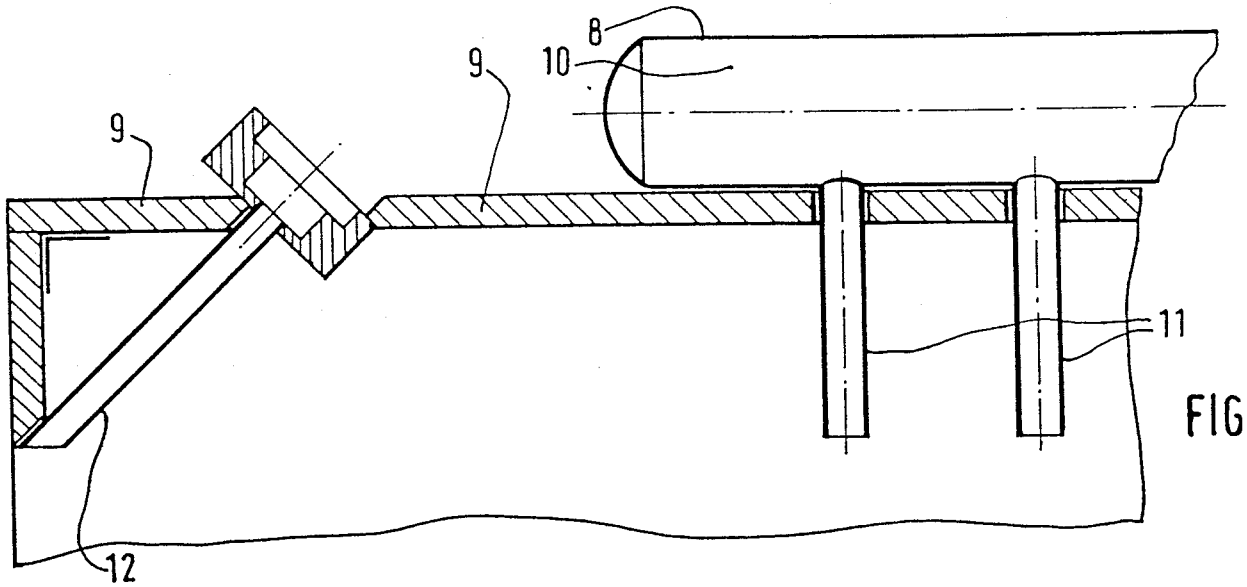
FIG. 3 is a profile view of the package purging ramp and the inerting gas injection means at the intake of the isolation minitunnel.

To upper part (9) of the hood of the isolation minitunnel, upstream from purge distributor (8), is fastened the device (12) for injection of inerting gas in the form of an oblique gas curtain covering the intake section of the inerting minitunnel (see FIG. 3).

Figure 4:
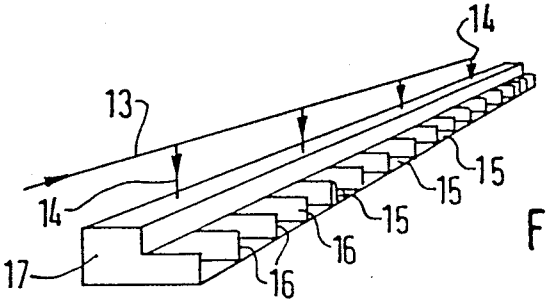
FIGS. 4, 5 and 6 respectively show a view of a linear inerting ramp and a circular ramp in front and top view, both provided with vertical slats assuring the division of the inerting delivery into several gas streams.
Figure 5:
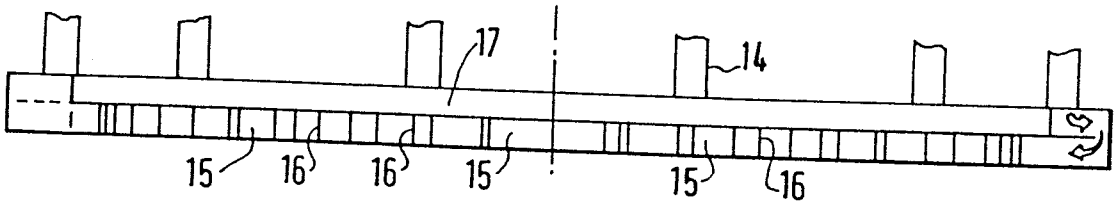
Figure 6:
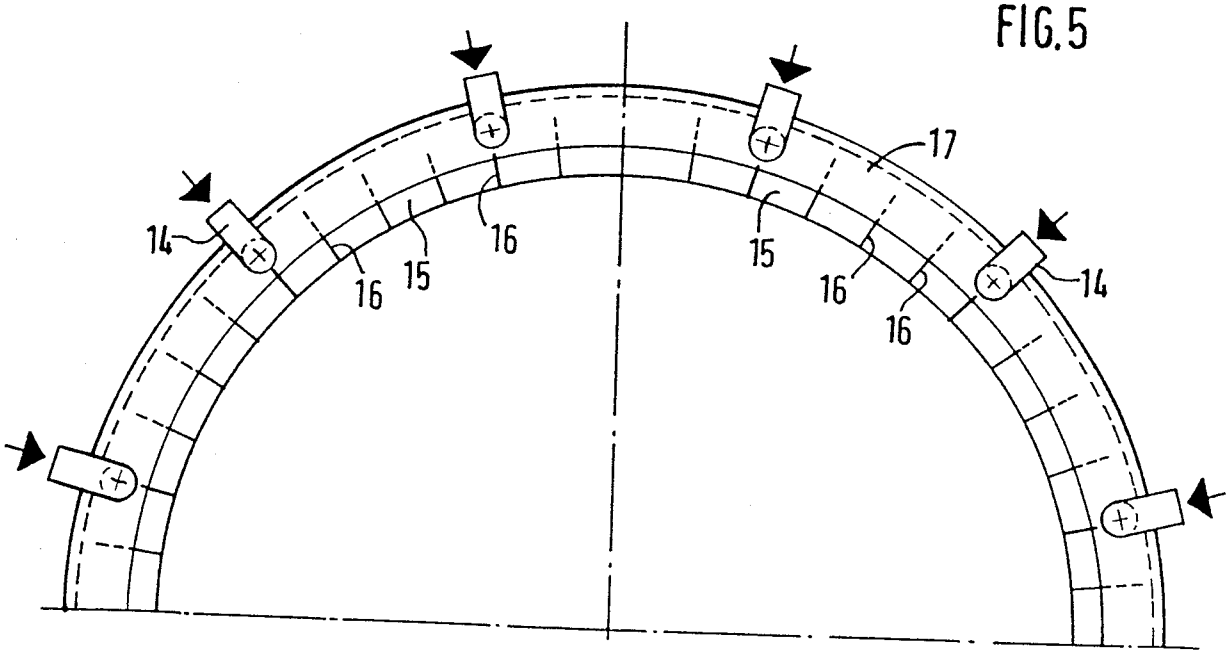

Gas injection flowing in a distributor (13) distributed by injection pipes (14) is performed through parallelepipedic sections (15) and is separated into several gas streams by vertical slats (16) placed inside the inerting distributor (17) as shown in FIGS. 4–6).

A nonlimiting embodiment is given below.

Example.

There is made according to the invention an isolation minitunnel (2) with a length of 1.15 meters, width of 0.115 m, height of 0.07 m, whose upper part or hood (9) is of transparent plastic. The purge distributor, fastened to the upper part of the hood of the minitunnel one meter long, is provided with 26 injection pipes (11) with a diameter of 6/8 millimeters. The intake section of isolation minitunnel is equipped with a flat jet nozzle (12), with a jet width of 0.2 millimeter.

The semicircular inerting minitunnel (5) is equipped with an inerting lamp 1.15 meter long, 0.01 m high.

This equipment is used for inerting of beer bottles before filling.

The packaging machine carries the glass bottles, whose volumes to be purged is 0.66 liters, at a rate of 25,000 bottles hour$^{-1}$, with a linear speed of 0.45 ms$^{-1}$.

The bottles are subjected to gas treatments by the purge distributor with a nitrogen delivery of 130 m$^3$h$^{-1}$, by an inerting distributor with a nitrogen delivery of 40 m$^3$h$^{-1}$, by the inerting gas curtain with a nitrogen delivery of 10 m$^3$h$^{-1}$.

For a nitrogen delivery of 180 m$^3$h$^{-1}$, the residual gaseous oxygen content in the empty packages is 1.4%.

While the invention is described above in relation to certain specific embodiments, it will be understood that many variations are possible, and that alternative materials and reagents can be used without departing from the invention. In some cases such variations and substitutions may require some experimentation, but such will only involve routine testing.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. An apparatus for producing airtight packages having an inert atmosphere, comprising:

an inerting minitunnel having an inlet end and an outlet end and comprising a hood covering the upper part of said packages with sidewalls extending at least partially vertically down the sides of said packages;

said hood being fitted close to the profile of said packages and adapted and constructed so that the passage of the profile of the packages is free on the inside of the inerting minitunnel;

means for moving said packages through said minitunnel;

said inerting minitunnel further comprising a purge distributor for feeding gaseous medium for purging any oxygen in said packages, said purge distributor having a maximum length relative to the hood of the minitunnel and being fastened to an upper part of said inerting tunnel;

said purge distributor comprising a feed duct for inerting gas and a plurality of injectors placed immediately above and centered over said packages;

an inerting distributor for providing a continuous stream of inerting gas in said minitunnel, said inerting distributor being of a length equal to said hood of said minitunnel and fastened to an upper lateral part of said minitunnel;

said minitunnel comprising in an upper part a device separate from said purge distributor and said inerting distributor for injection of inerting gas, directed downwardly, and covering said inlet end of said inerting minitunnel;

means for filling said packages downstream of said minitunnel.

2. The apparatus according to claim 1 wherein said device for injection of inert gas is placed perpendicular to the passage flow of empty packages.

3. The apparatus according to claim 1 wherein said device for injection of inert gas is placed obliquely relative to said passage flow of empty packages.

4. The apparatus according to claim 1 wherein a package filling station is placed in front of said inerting minitunnel.

5. The apparatus according to claim 1 wherein a package filling station is placed in a position surrounded on both sides by said inerting minitunnel.

6. The apparatus according to claim 1 wherein said purge distributor comprises from 1 to 10 injection pipes per package distance between centers, said injection pipes being cylindrical, vertical, directed downwardly, and placed several millimeters from the surface of said package.

7. The apparatus according to claim 1 wherein, as a function of the dimensions of the package, the height of the hood of the minitunnel ranges from less than the height of the packages to twice the height of the packages.

8. The apparatus according to claim 1 wherein said inerting distributor of said minitunnel comprises a parallelepipedic section of a length equal to the length of the hood of the tunnel and having a minimum height of 2 millimeters.

9. The apparatus according to claim 1 wherein said inerting distributor of said minitunnel comprises vertical slats placed on the inside of said inerting ramp, said slats being regularly spaced.

10. The apparatus according to claim 9 wherein the spacing between the vertical slates of said inerting distributor ranges from 0.5 cm to 10 cm.

11. The apparatus according to claim 1 wherein the packages contain a substance selected from the group consistinhg of beer, wine, fruit juice, milk products, oils, oil derivatives, lipidic products, pharmaceuticals, biological products, powders, and grains.

12. An apparatus for producing airtight packages having an inert atmosphere, comprising:

an inerting minitunnel having an inlet end and an outlet end and comprising a hood having a cross-section of an inverted U covering the upper parts of said packages with sidewalls extending at least partially vertically down the sides of said packages, said hood fitting close to said packages and being constructed so that the passage of the packages is free on the inside of said hood;

means for moving said packages through said minitunnel;

purge distribution means for feeding inert gas downwardly into each package as said package travels through said minitunnel, said purge distribution means comprising a feed duct for said inert gas and a plurality of injectors disposed immediately above and centrally over the packages as they travel through said minitunnel for blowing said inert gas into said packages to purge air therefrom;

inerting distribution means for providing a continuous lateral stream of inerting gas in said minitunnel at approximately the level of the upper ends of the packages passing therethrough, said inerting distribution means being of a length generally equal to the length of said hood; and gas curtain means for injection an inert gas separate from said purge distributor and said inerting distributor to form a gas curtain at said inlet end of said inerting minitunnel means for filling said packages downstream of said minitunnel.

13. Apparatus according to claim 12, wherein said hood extends downwardly to cover approximately the upper third of the height of said packages.

14. An apparatus according to claim 12, further comprising a package filling station downstream from said inerting minitunnel; and a second inerting minitunnel downstream from said package filling station, said second inerting minitunnel having an inlet and an outlet end and comprising a hood covering the upper part of said packages, said hood being provided with purge distributor means for feeding gaseous medium for purging oxygen from filled packages passing thereunder, and an inerting distributor means for providing a continuous stream of inerting gas in said second minitunnel.

* * * * *